US011499360B2

(12) United States Patent
Kim

(10) Patent No.: US 11,499,360 B2
(45) Date of Patent: Nov. 15, 2022

(54) GUIDE MECHANISM FOR SLIDING DOOR

(71) Applicants: Hyundai Motor Company, Seoul (KR); Kia Motors Corporation, Seoul (KR)

(72) Inventor: Sang Cheon Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 174 days.

(21) Appl. No.: 17/038,483

(22) Filed: Sep. 30, 2020

(65) Prior Publication Data

US 2021/0355736 A1 Nov. 18, 2021

(30) Foreign Application Priority Data

May 13, 2020 (KR) ..... 10-2020-0057396

(51) Int. Cl.
*E05F 11/00* (2006.01)
*E05F 15/649* (2015.01)
*E05F 15/655* (2015.01)

(52) U.S. Cl.
CPC ..... *E05F 15/649* (2015.01); *E05F 15/655* (2015.01); *E05Y 2201/41* (2013.01); *E05Y 2201/422* (2013.01); *E05Y 2201/624* (2013.01); *E05Y 2201/652* (2013.01); *E05Y 2201/684* (2013.01); *E05Y 2201/688* (2013.01); *E05Y 2201/706* (2013.01); *E05Y 2201/716* (2013.01); *E05Y 2201/722* (2013.01); *E05Y 2900/531* (2013.01)

(58) Field of Classification Search
CPC ..... E05F 15/649; E05F 15/655; E05F 15/646; E05F 15/56; E05F 15/643; E05Y 2201/422; E05Y 2201/41; E05Y 2201/624; E05Y 2201/652; E05Y 2201/684; E05Y 2201/688; E05Y 2201/706; E05Y 2201/716; E05Y 2201/722; E05Y 2201/71; E05Y 2900/531; B60J 5/06; E05D 15/10; E05D 15/0617
USPC ..... 49/358, 360
See application file for complete search history.

(56) References Cited

U.S. PATENT DOCUMENTS 4,640,050 A * 2/1987 Yamagishi ..... E05F 15/646 49/213
5,507,119 A * 4/1996 Sumiya ..... E05F 15/635 49/218
6,814,394 B2 * 11/2004 Yogo ..... B60J 5/06 49/360
7,533,926 B2 * 5/2009 Mitsui ..... B60J 5/06 49/358
7,798,557 B2 * 9/2010 Elliott ..... B60J 5/0479 296/146.12
7,810,282 B2 * 10/2010 Oxley ..... E05F 15/638 49/362

(Continued)

*Primary Examiner* — Jerry E Redman
(74) *Attorney, Agent, or Firm* — Slater Matsil, LLP

(57) ABSTRACT

A guide mechanism for a sliding door includes a rail configured to be mounted on the sliding door, a roller carriage configured to move along the rail, and including a roller bracket and a roller configured to be rotatably mounted on the roller bracket, a hinge arm configured to be pivotally connected to a vehicle body, a first shaft configured to pivotally connect the roller carriage to the hinge arm, and a second shaft configured to pivotally connect the hinge arm to the vehicle body.

20 Claims, 14 Drawing Sheets

(56) References Cited

U.S. PATENT DOCUMENTS

| | | | | |
|---|---|---|---|---|
| 7,856,759 | B2 * | 12/2010 | Elliott | E05D 15/58 49/358 |
| 7,896,425 | B2 * | 3/2011 | Elliott | E05D 15/101 296/146.12 |
| 7,950,719 | B2 * | 5/2011 | Elliott | B60J 5/06 296/155 |
| 8,096,606 | B2 * | 1/2012 | Hanaki | E05F 15/646 49/358 |
| 8,336,259 | B2 * | 12/2012 | Ishida | E05F 15/646 49/358 |
| 8,464,469 | B2 * | 6/2013 | Oberheide | E05F 15/646 49/360 |
| 8,893,436 | B2 * | 11/2014 | Choi | E05D 15/34 49/153 |
| 9,440,519 | B2 * | 9/2016 | Choi | E05D 15/101 |
| 9,587,724 | B2 * | 3/2017 | Choi | E05D 15/58 |
| 9,777,811 | B2 * | 10/2017 | Choi | B60J 5/06 |
| 10,633,908 | B1 * | 4/2020 | Loeb | E05D 15/1002 |
| 10,914,108 | B2 * | 2/2021 | Yun | B60J 5/06 |
| 2005/0044794 | A1 * | 3/2005 | Kriese | E05F 15/646 49/360 |
| 2009/0000200 | A1 * | 1/2009 | Heuel | B60J 5/062 296/202 |
| 2010/0095595 | A1 * | 4/2010 | Hanaki | E05D 15/101 49/359 |
| 2012/0272578 | A1 * | 11/2012 | Ellinghaus | E05D 15/101 49/358 |
| 2018/0087304 | A1 * | 3/2018 | Bauer | E05D 15/1047 |
| 2021/0172238 | A1 * | 6/2021 | Yun | E05D 15/1042 |
| 2021/0355736 | A1 * | 11/2021 | Kim | E05F 15/655 |

* cited by examiner

GUIDE MECHANISM FOR SLIDING DOOR

CROSS-REFERENCE TO RELATED APPLICATIONS

This application claims the benefit of Korean Patent Application No. 10-2020-0057396, filed on May 13, 2020, in the Korean Intellectual Property Office, which application is hereby incorporated herein by reference.

TECHNICAL FIELD

The present disclosure relates to a guide mechanism for a sliding door.

BACKGROUND

As is well-known in the art, vehicles have door apertures for ingress and egress of passengers into and out of a passenger compartment. A vehicle door is closed to block the door aperture and is opened to enable ingress and egress of passengers into and out of the passenger compartment through the door aperture. Vehicle doors are divided into swing doors and sliding doors. The swing door is opened and closed by swinging around a hinge mounted between the swing door and the vehicle body. The sliding door is opened and closed by sliding a roller carriage mounted on the sliding door along a rail mounted on the vehicle body.

In a sliding door system according to the related art, at least a portion of the rail is curved toward the interior of the vehicle so that the sliding door may be flush with the side of the vehicle body when the sliding door is closed. Specifically, the rail has a curved rail portion which is curved toward the interior of the vehicle, and a straight rail portion which extends straightly in a longitudinal direction of the vehicle. The roller carriage includes a roller which rolls along the rail, and a roller bracket to which the roller is rotatably mounted. As the roller bracket is pivotally connected to the sliding door through a shaft, and the roller rolls along the curved rail portion and the straight rail portion, the sliding door is opened and closed.

Since the sliding door system according to the related art occupies a relatively large mounting space on the side of the vehicle body due to the curved rail portion of the rail, a cross-sectional area of a side sill and a cross-sectional area of a roof side are reduced, and thus side stiffness of the vehicle body is relatively reduced.

In addition, it is difficult to secure enough space for mounting a battery on the bottom of the vehicle body due to the curved rail portion of the rail. Thus, it is difficult to increase a driving range of an electric vehicle.

The above information described in this background section is provided to assist in understanding the background of the inventive concept, and may include any technical concept which is not considered as the prior art that is already known to those skilled in the art.

SUMMARY

Embodiments of the present disclosure solve problems occurring in the prior art while advantages achieved by the prior art are maintained intact.

The present disclosure relates to a guide mechanism for a sliding door. Particular embodiments relate to a guide mechanism for a sliding door having a rail mounted on a sliding door and allowing a hinge arm to be pivotally connected to a vehicle body, thereby making a sliding door system compact.

An embodiment of the present disclosure provides a guide mechanism for a sliding door having a roller carriage connected to a vehicle body through a hinge arm and having a rail mounted on a sliding door, thereby making a sliding door system compact.

According to an embodiment of the present disclosure, a guide mechanism for a sliding door may include a rail mounted on a sliding door, a roller carriage moving along the rail, and including a roller bracket and a roller rotatably mounted on the roller bracket, a hinge arm pivotally connected to a vehicle body, a first shaft pivotally connecting the roller carriage to the hinge arm, and a second shaft pivotally connecting the hinge arm to the vehicle body.

The rail may be a straight rail extending straightly in a longitudinal direction of a vehicle.

The hinge arm may pivot around the second shaft to move between a first pivot position and a second pivot position. When the hinge arm is in the first pivot position, the sliding door may move to a fully closed position, and when the hinge arm is in the second pivot position, the sliding door may move to a fully open position.

The roller bracket and the hinge arm may rotate freely with respect to the first shaft, and the hinge arm may rotate freely with respect to the second shaft.

The hinge arm may pivot around the second shaft by a motor module and a transmission device. The motor module may be fixed to the roller bracket, and the first shaft may be connected to the motor module. The transmission device may include a first gear fixed to the first shaft, a second gear disposed around the second shaft, and a first belt connecting the first gear and the second gear. The second gear may be fixed to the hinge arm.

The first belt may include a plurality of first teeth meshing with teeth of the first gear and teeth of the second gear.

The guide mechanism may further include an attitude maintenance mechanism operatively connected to the transmission device. The attitude maintenance mechanism may include a third gear operatively connected to the first belt, a fourth gear fixed to the third gear, a fifth gear disposed around the first shaft, and a second belt connecting the fourth gear and the fifth gear, and the fifth gear may be connected to the roller bracket through the motor module.

The motor module may have a cylinder portion extending toward the fifth gear, the cylinder portion may surround the first shaft, and the fifth gear may be fixed to the cylinder portion.

The first belt may include a plurality of second teeth meshing with teeth of the third gear.

The hinge arm may pivot around the second shaft by a gear train and a transmission device, and the gear train may turn a linear movement of the sliding door into a rotational movement of the first shaft. The transmission device may include a first gear rotatably mounted on the first shaft, a second gear rotatably mounted on the second shaft, and a first belt connecting the first gear and the second gear. The first gear may be operatively connected to the gear train, and the second gear may be fixed to the hinge arm.

The gear train may include a driving gear contacting the rail, a first intermediate gear meshing with the driving gear, a second intermediate gear fixed to the first intermediate gear, and a driven gear meshing with the second intermediate gear. The driven gear may be fixed to the first gear.

The guide mechanism may further include an attitude maintenance mechanism operatively connected to the transmission device. The attitude maintenance mechanism may include a third gear operatively connected to the first belt, a fourth gear fixed to the third gear, a fifth gear fixed to the first shaft, and a second belt connecting the fourth gear and the fifth gear. The first shaft may be fixed to the roller bracket.

BRIEF DESCRIPTION OF THE DRAWINGS

The above and other objects, features and advantages of embodiments of the present disclosure will be more apparent from the following detailed description taken in conjunction with the accompanying drawings, in which.

DETAILED DESCRIPTION OF ILLUSTRATIVE EMBODIMENTS

Figure 1:
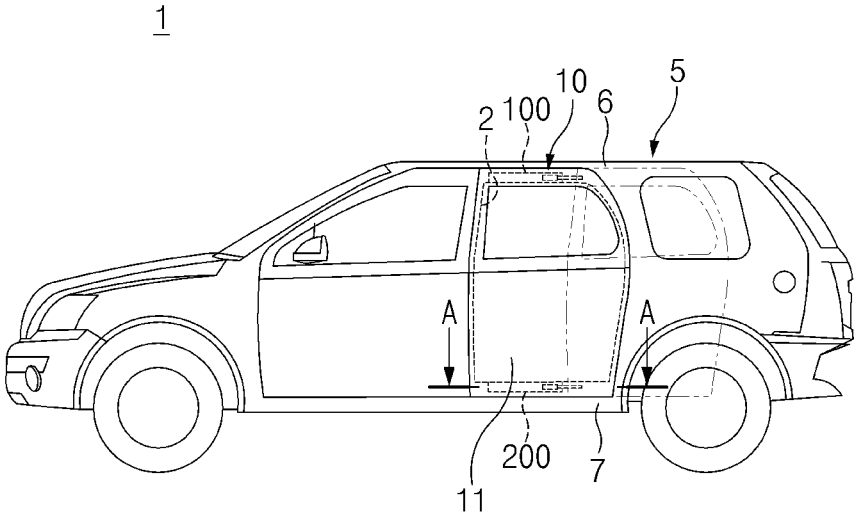
FIG. 1 illustrates a side view of a vehicle to which a sliding door system according to an exemplary embodiment of the present disclosure is applied.

Hereinafter, exemplary embodiments of the present disclosure will be described in detail with reference to the accompanying drawings. For reference, the dimensions of elements, thicknesses of lines, and the like, illustrated in the drawings referred to in the description of exemplary embodiments of the present disclosure, may be exaggerated for convenience of understanding. Terms used for describing the present inventive concept have been defined in consideration of the functions of elements, and may be altered in accordance with the intention of a user or an operator, in view of practice, or the like. Therefore, the terms should be defined on the basis of the entirety of this specification.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, a vehicle 1 according to an exemplary embodiment of the present disclosure may have a door aperture 2, and a sliding door 11 may slide in a longitudinal direction of the vehicle to cover and uncover the door aperture 2.

Referring to FIGS. 1 and 2, a sliding door system 10 for a vehicle according to an exemplary embodiment of the present disclosure may include the sliding door 11 and one or more guide mechanisms 100 and 200 guiding a movement of the sliding door 11.

According to an exemplary embodiment, the guide mechanisms 100 and 200 may include an upper guide mechanism 100 mounted between a roof side 6 of a vehicle body 5 and an upper portion of the sliding door 11, and a lower guide mechanism 200 mounted between a side sill 7 of the vehicle body 5 and a lower portion of the sliding door 11.

Each of the guide mechanisms 100 and 200 may include a rail 12 mounted on the sliding door 11, a roller carriage 13 moving along the rail 12, a hinge arm 14 pivotally connected to the vehicle body 5, a first shaft 21 pivotally connecting the roller carriage 13 to the hinge arm 14, and a second shaft 22 pivotally connecting the hinge arm 14 to the vehicle body 5.

The rail 12 of the upper guide mechanism 100 may be an upper rail that is mounted on the upper portion of the sliding door 11 adjacent to the roof side 6 of the vehicle body 5 using fasteners, welding, and/or the like. The roller carriage 13 of the upper guide mechanism 100 may be an upper roller carriage that is movable along the upper rail. The hinge arm 14 of the upper guide mechanism 100 may be an upper hinge arm that is pivotally connected to a portion of the vehicle body 5 adjacent to the roof side 6.

Likewise, the rail 12 of the lower guide mechanism 200 may be a lower rail that is mounted on the lower portion of the sliding door 11 using fasteners, welding, and/or the like. The roller carriage 13 of the lower guide mechanism 200 may be a lower roller carriage that is movable along the lower rail. The hinge arm 14 of the lower guide mechanism 200 may be a lower hinge arm that is pivotally connected to a portion of the vehicle body 5 adjacent to the side sill 7.

The rail 12 may be mounted on an inner wall of the sliding door 11, and the inner wall of the sliding door 11 may face an interior space of the vehicle.

According to an exemplary embodiment of the present disclosure, since the rail 12 is mounted on the sliding door 11, the rail 12 may be a straight rail extending straightly in the longitudinal direction of the vehicle. An axis of the rail 12 may be substantially parallel to a longitudinal axis of the vehicle. That is, since the rail 12 according to the exemplary embodiment of the present disclosure is the straight rail 12 which does not have a curved portion, it may be easy to manufacture the straight rail and reduce its manufacturing cost compared to a curved rail according to the related art. In addition, since the length of the straight rail is relatively reduced compared to the related art curved rail, the weight thereof may also be reduced.

In addition, the straight rail 12 of the same shape and the same dimension may be provided for the upper guide mechanism 100 and the lower guide mechanism 200. Thus, the straight rail 12 may be equally applied to the upper guide mechanism 100 and the lower guide mechanism 200.

The roller carriage 13 may include a roller bracket 15 and a plurality of rollers 16 mounted on the roller bracket 15. As the rollers 16 roll along the rail 12, a movement of the rail 12 may be guided by the rollers, and the roller bracket 15 may move along the rail 12.

The hinge arm 14 may be mounted on a side outer of the vehicle body 5, and the hinge arm 14 may have a first body 17 and a second body 18. A length of the first body 17 may be greater than a length of the second body 18, and the second body 18 may extend from the first body 17 toward the vehicle body 5. The second body 18 may be angled from the first body 17 at a predetermined angle. That is, the second body 18 may intersect with the first body 17 at a predetermined angle. For example, the second body 18 may be substantially perpendicular to the first body 17. When the hinge arm 14 pivots around the second shaft 22, the hinge arm 14 may be prevented from interfering with the vehicle body 5.

The first shaft 21 may pass through the roller bracket 15 of the roller carriage 13 and the first body 17 of the hinge arm 14, and thus the roller bracket 15 of the roller carriage 13 may be pivotally connected to the hinge arm 14 through the first shaft 21.

The second shaft 22 may be rotatably supported with respect to the vehicle body 5 through a support bracket 19, and the support bracket 19 may be mounted on portions of the vehicle body 5 adjacent to the roof side 6 and the side sill 7. The second shaft 22 may pass through a free end of the second body 18 of the hinge arm 14 and the support bracket 19, and thus the hinge arm 14 may be pivotally mounted on the support bracket 19 of the vehicle body 5 through the second shaft 22.

Figure 2A:
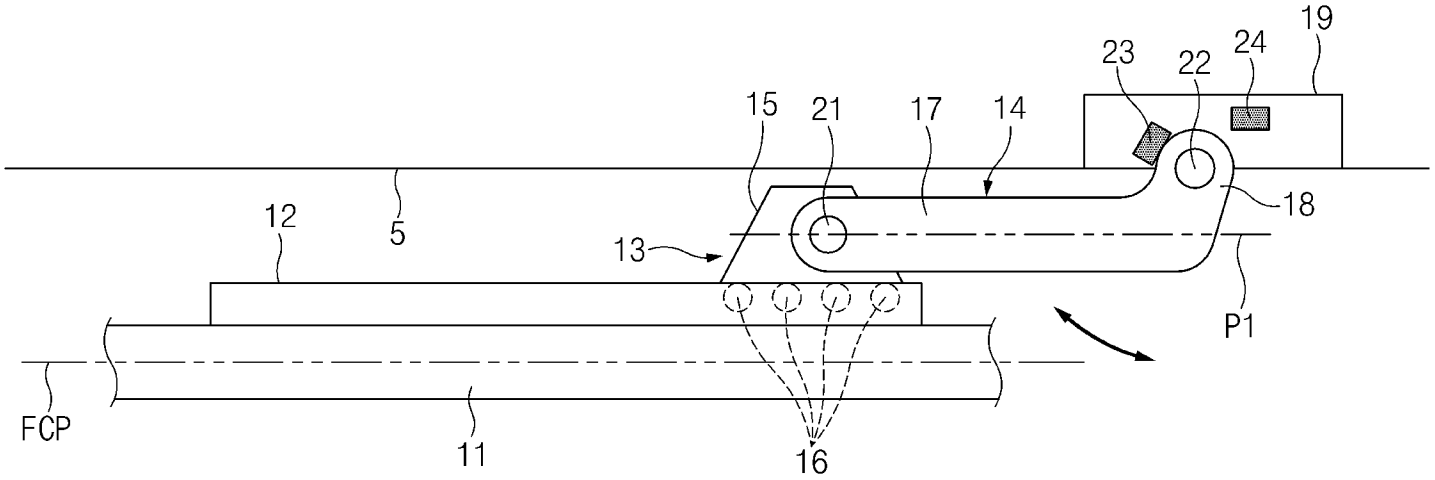
FIG. 2A illustrates a cross-sectional view taken along line A-A of FIG. 1, in a state in which a sliding door is fully closed.
Figure 2B:
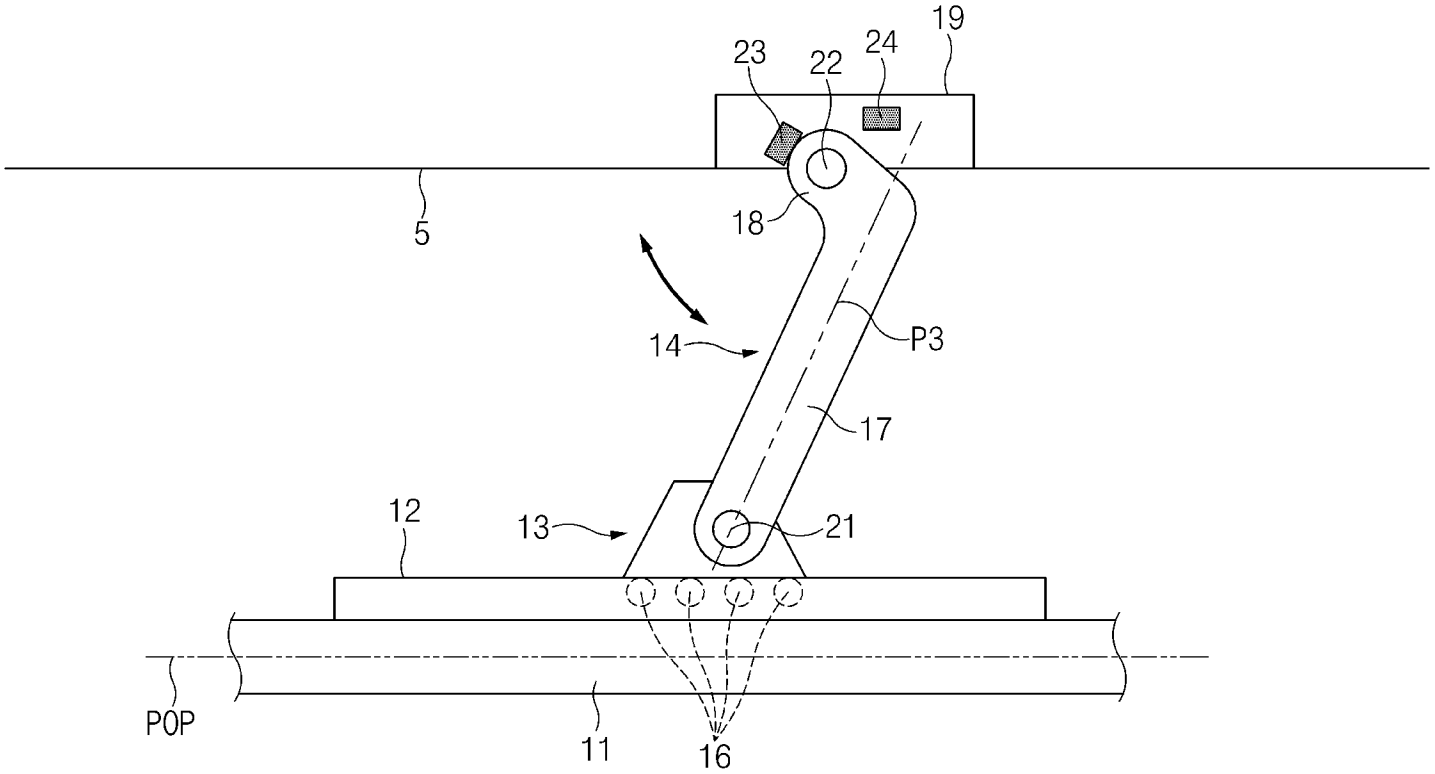
FIG. 2B illustrates a cross-sectional view taken along line A-A of FIG. 1, in a state in which a sliding door is partially opened.
Figure 2C:
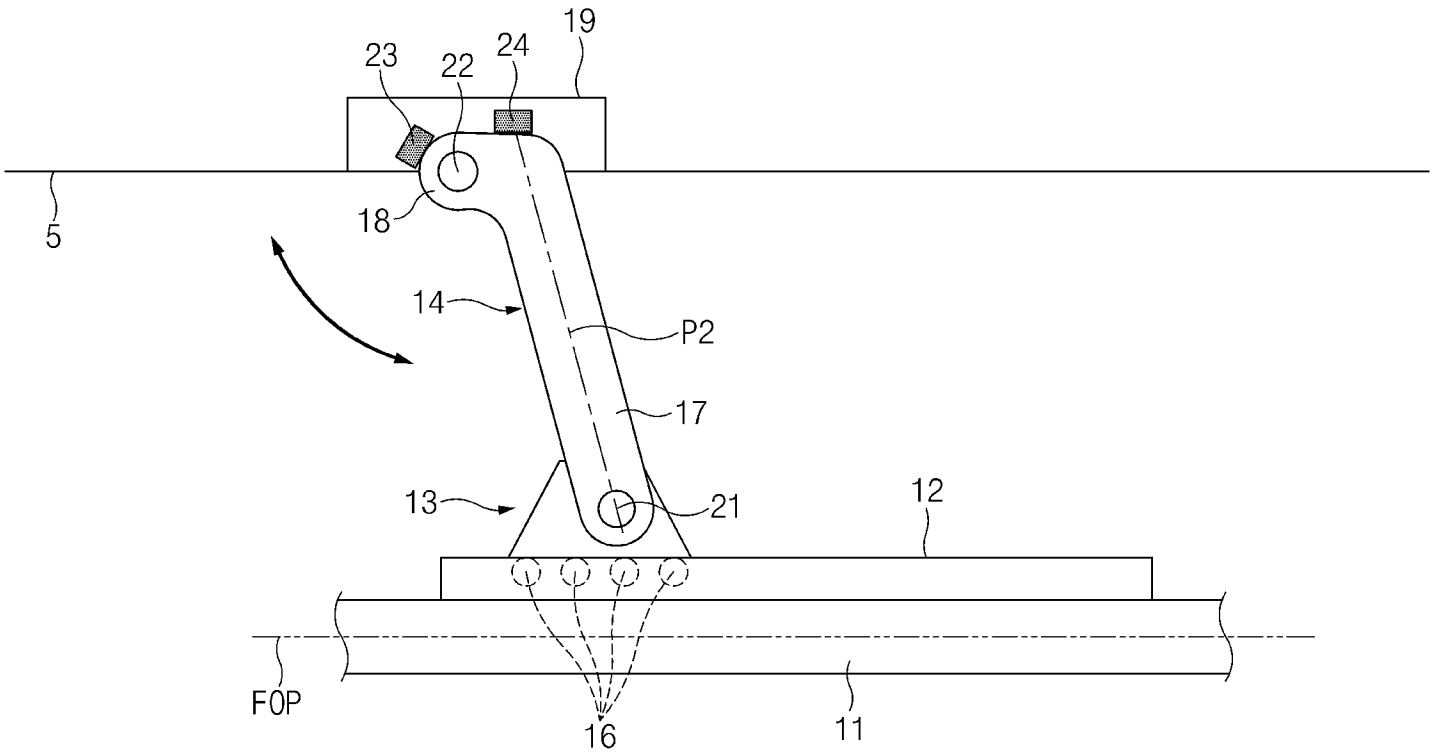
FIG. 2C illustrates a cross-sectional view taken along line A-A of FIG. 1, in a state in which a sliding door is fully opened.

As the hinge arm 14 pivots around the second shaft 22, the hinge arm 14 may move between a first pivot position P1 (see FIG. 2A) and a second pivot position P2 (see FIG. 2C).

Referring to FIG. 2A, the first pivot position P1 refers to a position in which the first body 17 of the hinge arm 14 comes close to the vehicle body 5. In the first pivot position P1, an axis of the first body 17 of the hinge arm 14 may be parallel to the side of the vehicle body 5 and the longitudinal axis of the vehicle. When the hinge arm 14 is in the first pivot position P1, the sliding door 11 may move to a fully closed position FCP. That is, when the hinge arm 14 moves to the first pivot position P1 in a manner that comes close to the vehicle body 5, the sliding door 11 may be fully closed.

Referring to FIG. 2C, the second pivot position P2 refers to a position in which the first body 17 of the hinge arm 14 is farthest from the vehicle body 5. In the second pivot position P2, the axis of the first body 17 of the hinge arm 14 may be tilted with respect to the side of the vehicle body 5 and the longitudinal axis of the vehicle at a maximum angle. When the hinge arm 14 moves to the second pivot position P2, the sliding door 11 may move to a fully open position FOP. That is, when the hinge arm 14 moves to the second pivot position P2 in a manner that moves far away from the vehicle body 5, the sliding door 11 may be fully opened.

When the hinge arm 14 moves to a third pivot position P3 between the first pivot position P1 and the second pivot position P2, the sliding door 11 may move to a partially open position (POP). That is, when the hinge arm 14 moves to the third pivot position P3, the sliding door 11 may be partially opened.

The support bracket 19 may further include a stopper regulating a pivot angle of the hinge arm 14. Referring to FIGS. 2A to 2C, the support bracket 19 may have a first stopper 23 and a second stopper 24 regulating the position of the hinge arm 14 between the first pivot position P1 and the second pivot position P2. The first stopper 23 and the second stopper 24 may be spaced apart from each other in a manner that corresponds to the pivot angle and pivot trajectory of the hinge arm 14.

As illustrated in FIG. 2A, when the hinge arm 14 moves to the first pivot position P1, the second body 18 of the hinge arm 14 may come into contact with the first stopper 23 so that the position of the hinge arm 14 may be regulated with respect to the first pivot position P1.

As illustrated in FIG. 2C, when the hinge arm 14 moves to the second pivot position P2, the second body 18 of the hinge arm 14 may come into contact with the first stopper 23 and the second stopper 24 so that the position of the hinge arm 14 may be regulated with respect to the second pivot position P2.

According to an exemplary embodiment, since the roller bracket 15 of the roller carriage 13 and the first body 17 of the hinge arm 14 are not fixed to the first shaft 21, the roller bracket 15 of the roller carriage 13 and the first body 17 of the hinge arm 14 may rotate (pivot) freely with respect to the first shaft 21. The roller bracket 15 of the roller carriage 13 may rotate (pivot) freely with respect to the first body 17 of the hinge arm 14 through the first shaft 21. The second body 18 of the hinge arm 14 may rotate (pivot) freely with respect to the second shaft 22. As the second body 18 of the hinge arm 14 rotates freely around an axis of the second shaft 22, and the roller bracket 15 of the roller carriage 13 rotates freely around an axis of the first shaft 21, the sliding door 11 may be opened and closed.

In the sliding door system according to exemplary embodiments of the present disclosure, the hinge arm 14 may be pivotally connected to the vehicle body 5, and the rail 12 may be fixed to the sliding door 11 so that the rail 12 may not be exposed to the interior and exterior of the vehicle when the sliding door 11 is opened, and thus exterior styling may be improved.

Figure 3:
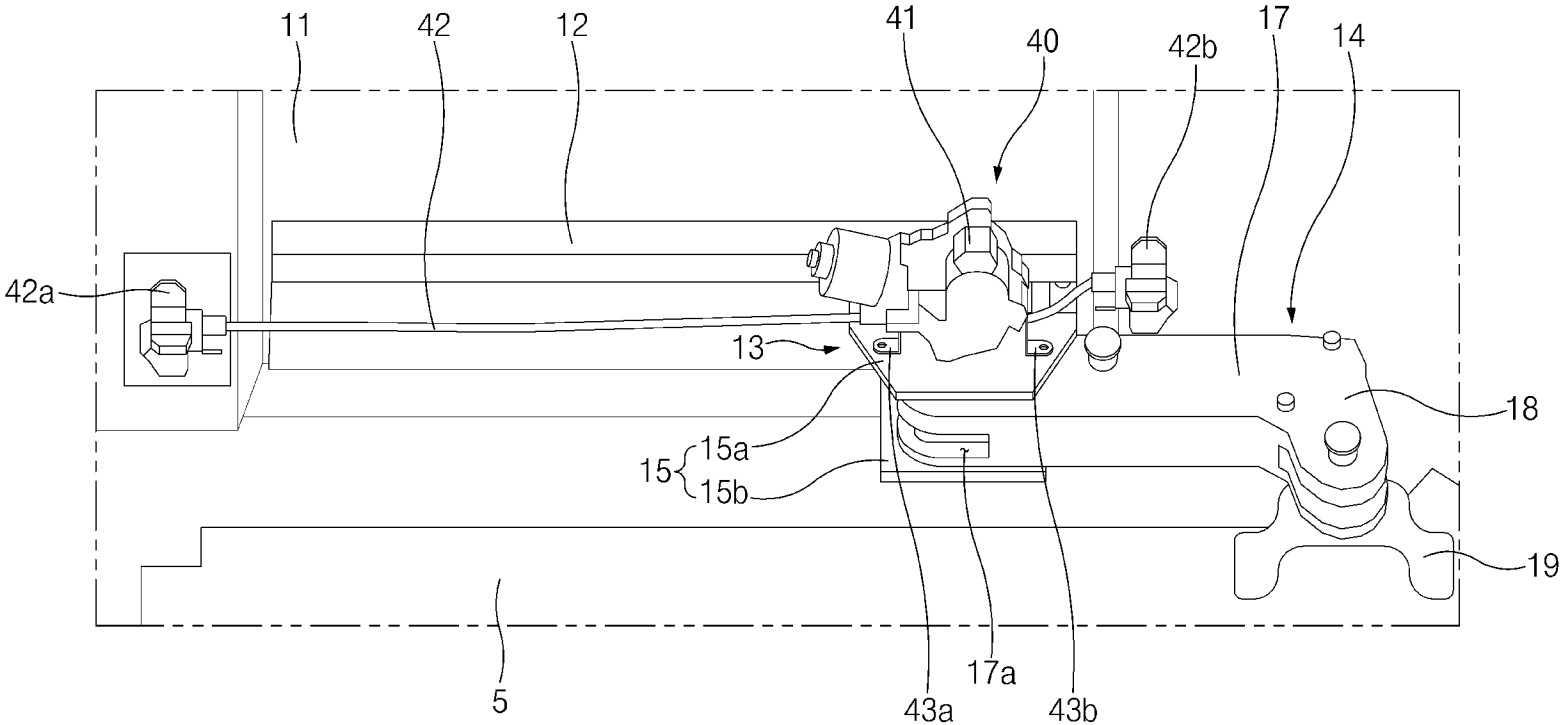
FIG. 3 illustrates a perspective view of a guide mechanism for a sliding door according to an exemplary embodiment of the present disclosure.
Figure 4:
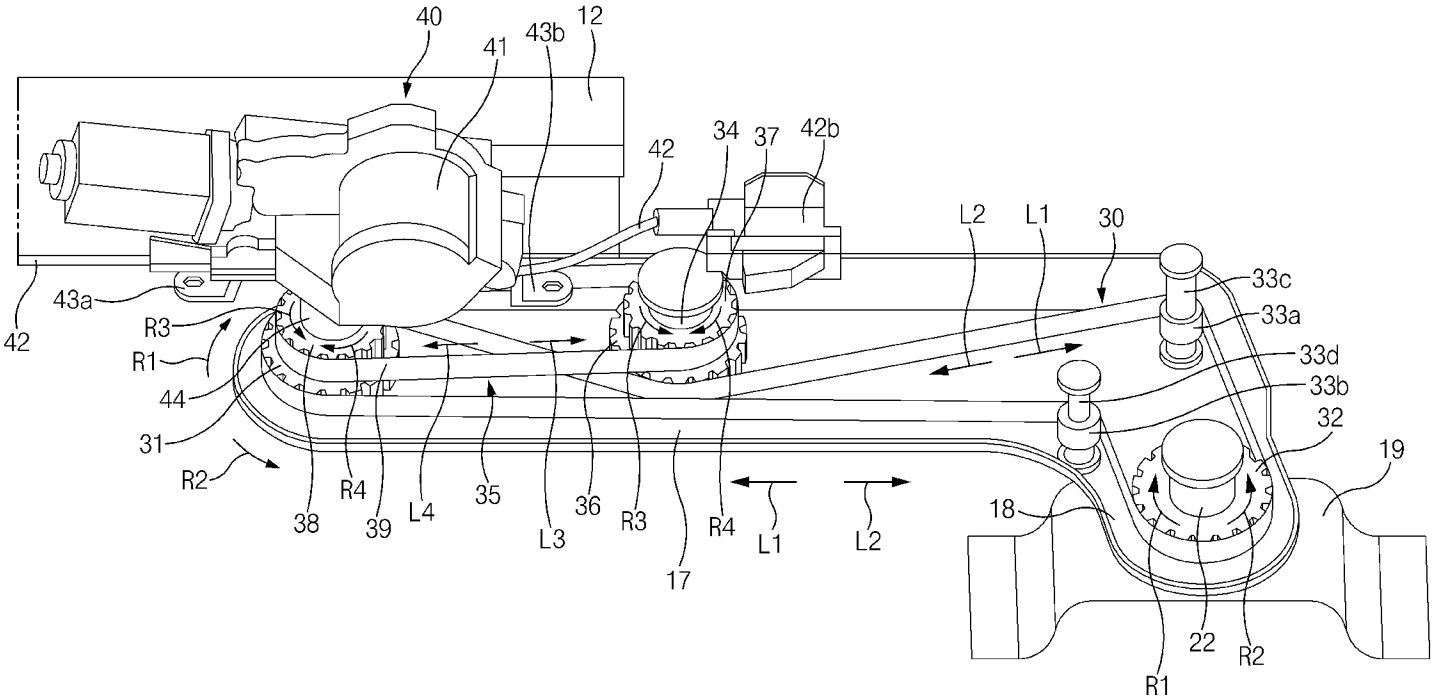
FIG. 4 illustrates a structure of the guide mechanism for a sliding door illustrated in FIG. 3 from which a roller bracket and a top of a hinge arm are removed.

Referring to FIGS. 3 and 4, at least one of the upper guide mechanism 100 and the lower guide mechanism 200 may further include a motor module 40 generating mechanical power, such as a rotational force or torque, using electrical energy, and a first transmission device 30 transmitting the mechanical power generated by the motor module 40 to the hinge arm 14. That is, the hinge arm 14 may pivot around the second shaft 22 by the motor module 40 and the first transmission device 30. That is, when the electrical energy is applied to the motor module 40, the first shaft 21 may rotate by the operation of the motor module 40, and the rotational force of the first shaft 21 may be transmitted to the hinge arm 14 through the first transmission device 30, and thus the hinge arm 14 may pivot around the second shaft 22.

The hinge arm 14 may have a space for receiving the first transmission device 30 therein, and the first body 17 of the hinge arm 14 may have an opening 17*a*.

The motor module 40 may include a rotor 41*a*, a stator 41*b*, and a motor housing 41. The rotor 41*a* and the stator 41*b* may be received in the motor housing 41. The motor module 40 may be a bidirectional motor in which the rotor 41*a* is rotatable in both directions.

As the first shaft 21 is directly connected to the motor module 40, the first shaft 21 may be rotatable by the operation of the motor module 40 in both directions. Specifically, the first shaft 21 may extend from the rotor 41*a* of the motor housing 41 toward the outside of the motor housing 41. Specifically, the first shaft 21 may be directly connected to the rotor 41*a* of the motor housing 41, and the first shaft 21 may be rotatable by the operation of the motor module 40 in both directions.

The motor housing 41 may be connected to the roller bracket 15 of the roller carriage 13. For example, the motor housing 41 may have two mounting legs 43*a* and 43*b* extending toward the roller bracket 15 of the roller carriage 13, and the mounting legs 43*a* and 43*b* and the roller bracket 15 may be joined using fasteners, welding, and/or the like, and thus the motor housing 41 may be fixed to the roller bracket 15.

Referring to FIG. 3, the roller bracket 15 may have an upper plate 15*a* and a lower plate 15*b* spaced apart from each other, and the mounting legs 43*a* and 43*b* of the motor housing 41 may be joined to the upper plate 15*a* of the roller bracket 15. The first shaft 21 may be rotatably supported to the lower plate 15*b* of the roller bracket 15 through bushings, bearings, and/or the like.

Figure 5:
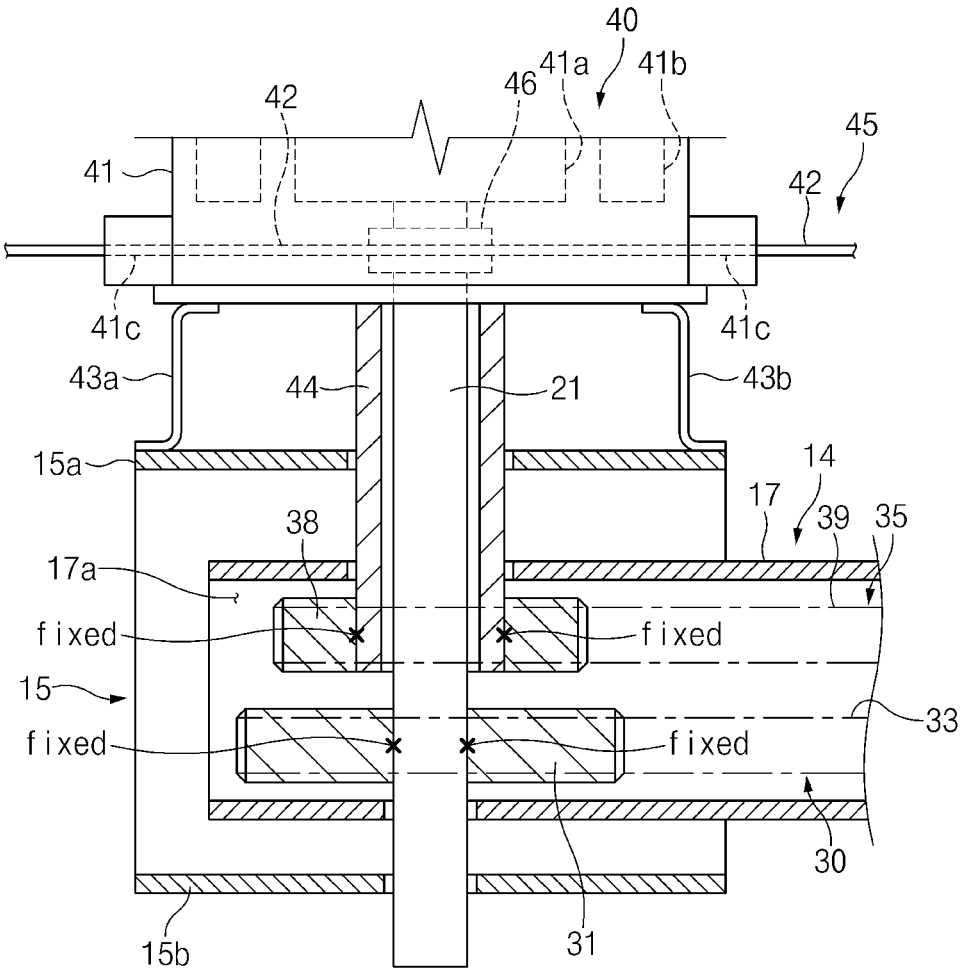
FIG. 5 illustrates a cross-sectional view of the guide mechanism for a sliding door illustrated in FIG. 3 in which a hinge arm and a roller bracket are connected by a motor module and a first shaft.

The first transmission device 30 may be mounted in the hinge arm 14. Referring to FIGS. 4 and 5, the first transmission device 30 may include a first gear 31 fixed to the first shaft 21, a second gear 32 disposed around the second shaft 22, and a first belt 33 connecting the first gear 31 and the second gear 32.

The first gear 31 may have teeth spaced apart from each other at a predetermined pitch on an outer peripheral surface thereof, and an inner peripheral surface of the first gear 31 may be fixed to the first shaft 21. For example, the inner peripheral surface of the first gear 31 may be fixed to an outer peripheral surface of the first shaft 21 using keyed joints, welding, and/or the like. As another example, the first gear 31 may be one-piece construction with the first shaft 21.

The second gear 32 may have teeth spaced apart from each other at a predetermined pitch on an outer peripheral surface thereof, and the second gear 32 may be rotatably mounted on the second shaft 22.

The second gear 32 may freely rotate with respect to the second shaft 22. Specifically, an inner peripheral surface of the second gear 32 may be rotatably supported to an outer peripheral surface of the second shaft 22 using keyed joints, welding, and/or the like. A bottom surface of the second gear 32 may be fixed to the bottom of the second body 18 of the hinge arm 14 using fasteners, welding, and/or the like, and the second gear 32 may rotate around the second shaft 22, and thus the hinge arm 14 may pivot around the second shaft 22 by the rotation of the second gear 32.

Figure 6A:
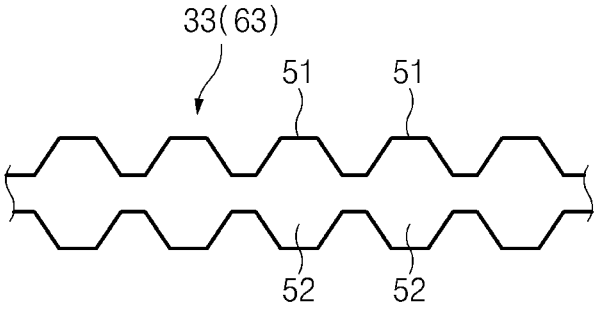
FIG. 6A illustrates a cross-sectional view of a first belt illustrated in FIG. 4.

The first belt 33 may have an inner surface facing the first gear 31 and the second gear 32, and an outer surface opposing the inner surface. As illustrated in FIG. 6A, the first belt 33 may include a plurality of first teeth 51 spaced apart from each other at a predetermined pitch on the inner surface thereof, and a plurality of second teeth 52 spaced apart from each other at a predetermined pitch on the outer surface thereof. The plurality of first teeth 51 may mesh with the teeth of the first gear 31 and the teeth of the second gear 32. The plurality of second teeth 52 may mesh with teeth of a third gear 36 of an attitude maintenance mechanism 35 to be described below. As a gear ratio between the first teeth 51 of the first belt 33, the teeth of the first gear 31, and the teeth of the second gear 32 is varied, a pivot range of the hinge arm 14 may be adjusted.

A plurality of guide rollers 33*a* and 33*b* may be disposed between the first gear 31 and the second gear 32, and the guide rollers 33*a* and 33*b* may be disposed around posts 33*c* and 33*d*, respectively. For example, the guide rollers 33*a* and 33*b* may be rotatably mounted on the corresponding posts 33*c* and 33*d*. The first belt 33 may be tensioned and guided to the first gear 31 and the second gear 32 by the plurality of guide rollers 33*a* and 33*b*. In particular, the plurality of guide rollers 33*a* and 33*b* may be disposed in a portion of the hinge arm 14 where the first body 17 and the second body 18 meet, and thus the first belt 33 may be tensioned and guided more stably.

At least one of the upper guide mechanism 100 and the lower guide mechanism 200 may further include the attitude maintenance mechanism 35 which maintains the sliding door 11 in a predetermined attitude, and the attitude maintenance mechanism 35 may be operatively connected to the first transmission device 30. When the sliding door 11 is opened and closed, the sliding door 11 may be maintained in a predetermined attitude by the attitude maintenance mechanism 35 so that the opening and closing operation of the sliding door 11 may be facilitated.

Preferably, the attitude maintenance mechanism 35 may maintain the sliding door 11 in an attitude parallel to the longitudinal axis of the vehicle or the side of the vehicle.

The attitude maintenance mechanism 35 may include the third gear 36 operatively connected to the first belt 33 of the first transmission device 30, a fourth gear 37 fixed to a top surface of the third gear 36, a fifth gear 38 disposed around the first shaft 21, and a second belt 39 connecting the fourth gear 37 and the fifth gear 38.

The third gear 36 may be coaxially aligned with the fourth gear 37, and the third gear 36 and the fourth gear 37 may be rotatably mounted on a post 34. The post 34 may be located between the first shaft 21 and the second shaft 22. The post 34 may be mounted within the first body 17 of the hinge arm 14, and an axis of the post 34 may be parallel to the axis of the first shaft 21.

An inner peripheral surface of the third gear 36 may be rotatably supported with respect to an outer peripheral surface of the post 34 through bushings, bearings, and/or the like. The third gear 36 may have the plurality of teeth spaced apart from each other at a predetermined pitch on an outer peripheral surface thereof, and the second teeth 52 of the first belt 33 of the first transmission device 30 may mesh with the teeth of the third gear 36. As the second teeth 52 of the first belt 33 mesh with the teeth of the third gear 36, the third gear 36 may be rotated by the movement of the first belt 33.

The fourth gear 37 may have a plurality of teeth spaced apart from each other at a predetermined pitch on an outer peripheral surface thereof, and the fourth gear 37 may be fixed to the top surface of the third gear 36 using fasteners, welding, and/or the like. An inner peripheral surface of the fourth gear 37 may be rotatably supported with respect to the outer peripheral surface of the post 34 through bushings, bearings, and/or the like. The third gear 36 together with the fourth gear 37 may rotate around the post 34 in the same direction.

The fifth gear 38 may be rotatably disposed around the first shaft 21, and the fifth gear 38 may have a plurality of teeth spaced apart from each other at a predetermined pitch on an outer peripheral surface thereof. The fifth gear 38 may be connected to the roller bracket 15 through the motor module 40. The motor module 40 may have a cylinder portion 44 extending from the motor housing 41 toward the fifth gear 38, and the fifth gear 38 may be joined to the motor housing 41 through the cylinder portion 44. The cylinder portion 44 may be one-piece construction with the motor housing 41, and an inner peripheral surface of the fifth gear 38 may be fixed to an outer peripheral surface of the cylinder portion 44 using keyed joints, welding, and/or the like. The fifth gear 38 and the cylinder portion 44 may rotate with the motor housing 41 around the axis of the first shaft 21. The cylinder portion 44 may surround the outer peripheral surface of the first shaft 21, and the first shaft 21 may be rotatably supported with respect to an inner peripheral surface of the cylinder portion 44 through bushings, bearings, and/or the like. That is, as the first shaft 21 rotates freely with respect to the cylinder portion 44, the first shaft 21 may rotate freely without being restricted by the motor housing 41 and the roller bracket 15.

Figure 6B:
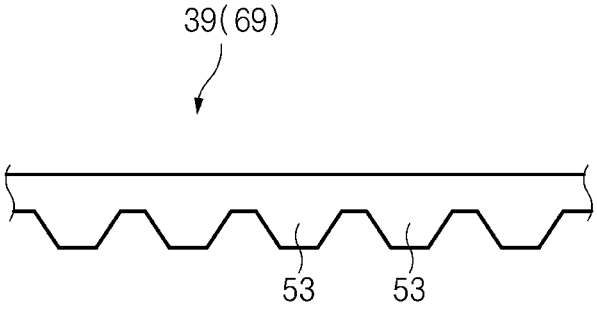
FIG. 6B illustrates a cross-sectional view of a second belt illustrated in FIG. 4.

As illustrated in FIG. 6B, the second belt 39 may have a plurality of teeth 53 meshing with the teeth of the fourth gear 37 and the teeth of the fifth gear 38. As the second belt 39 moves, the fourth gear 37 and the fifth gear 38 may rotate in the same direction.

Referring to FIG. 4, when the motor module 40 operates to open the sliding door 11, the first shaft 21 may rotate in a first rotation direction R1 by the operation of the motor module 40. The first gear 31 may rotate with the first shaft 21 in the first rotation direction R1, and the first belt 33 may move in a first direction L1 by the rotation of the first gear 31, and thus the second gear 32 may rotate in the first rotation direction R1. When the second gear 32 rotates in the first rotation direction R1, the hinge arm 14 may pivot from the first pivot position P1 to the third pivot position P3 and/or the second pivot position P2. That is, in order to open the sliding door 11, the hinge arm 14 may pivot from the first pivot position P1 to the third pivot position P3 and/or the second pivot position P2 by the first transmission device 30. When the first gear 31 rotates in the first rotation direction R1, the third gear 36 meshing with the second teeth 52 of the first belt 33 may rotate in a third rotation direction R3, and the fourth gear 37 may rotate with the third gear 36 in the third rotation direction R3. The third rotation direction R3 may be opposite to the first rotation direction R1. As the fourth gear 37 rotates in the third rotation direction R3, the second belt 39 may move in a third direction L3, and thus the fifth gear 38 may rotate in the third rotation direction R3, and the motor housing 41 and the roller bracket 15 may rotate with the fifth gear 38 in the third rotation direction R3. Since the third rotation direction R3 is opposite to the first rotation direction R1, the roller bracket 15, the rail 12, and the sliding door 11 may receive the rotational force in the opposite direction to the pivot direction of the hinge arm 14, and thus the sliding door 11 may be maintained in the attitude parallel to the side of the vehicle body 5 when the sliding door 11 is opened.

Referring to FIG. 4, when the motor module 40 operates to close the sliding door 11, the first shaft 21 may rotate in a second rotation direction R2 by the operation of the motor module 40. The first gear 31 may rotate with the first shaft 21 in the second rotation direction R2, and the first belt 33 may move in a second direction L2 by the rotation of the first gear 31, and thus the second gear 32 may rotate in the second rotation direction R2. As the second gear 32 rotates in the second rotation direction R2, the hinge arm 14 may pivot from the second pivot position P2 (see FIG. 2C) to the third pivot position P3 (see FIG. 2B) and/or the first pivot position P1 (see FIG. 2A). That is, in order to close the sliding door 11, the hinge arm 14 may pivot from the second pivot position P2 to the third pivot position P3 and/or the first pivot position P1 by the first transmission device 30. When the first belt 33 moves in the second direction L2, the third gear 36 meshing with the second teeth 52 of the first belt 33 may rotate in a fourth rotation direction R4, and the fourth gear 37 may rotate with the third gear 36 in the fourth rotation direction R4. The fourth rotation direction R4 may be opposite to the second rotation direction R2. As the fourth gear 37 rotates in the fourth rotation direction R4, the second belt 39 may move in a fourth direction L4, and thus the fifth gear 38 may rotate in the fourth rotation direction R4, and the motor housing 41 and the roller bracket 15 may rotate with the fifth gear 38 in the fourth rotation direction R4. Since the fourth rotation direction R4 is opposite to the second rotation direction R2, the roller bracket 15, the rail 12, and the sliding door 11 may rotate in the opposite direction to the pivot direction of the hinge arm 14, and thus the sliding door 11 may be maintained in the attitude parallel to the side of the vehicle body 5 when the sliding door 11 is closed.

Figure 7:
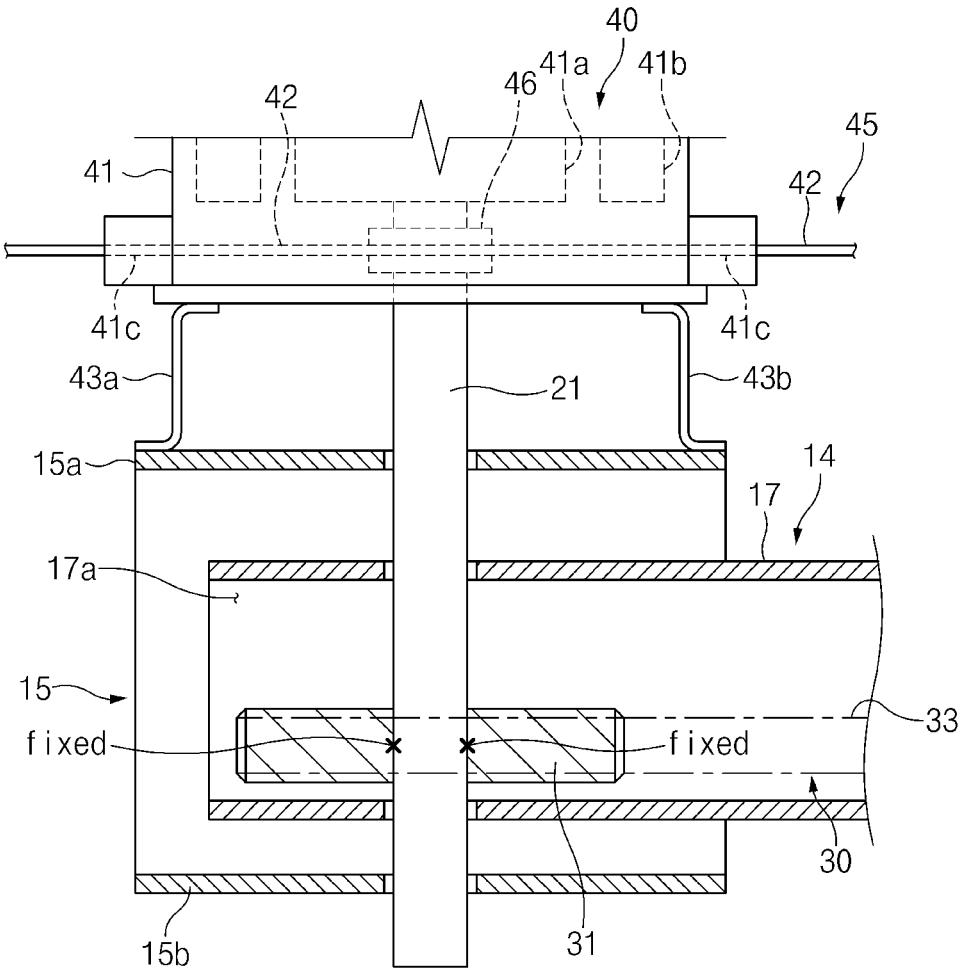
FIG. 7 illustrates a modification to the embodiment of FIG. 5.

FIG. 7 illustrates a modification to the exemplary embodiment of FIG. 5. In the modified embodiment of FIG. 7, the attitude maintenance mechanism operatively connected to the first transmission device 30 is removed. Referring to FIG. 7, the first shaft 21 may rotate freely with respect to the upper plate 15*a* and the lower plate 15*b* of the roller bracket 15. That is, the first shaft 21 may be rotatably supported with respect to the upper plate 15*a* and the lower plate 15*b* of the roller bracket 15 through bushings, bearings, and/or the like. The first shaft 21 may be rotatably supported with respect to the first body 17 of the hinge arm 14 through bushings, bearings, and/or the like.

According to the exemplary embodiment of FIG. 7, the first shaft 21 may rotate freely with respect to the first body 17 of the hinge arm 14 and the roller bracket 15, and the attitude maintenance mechanism may be removed. In the exemplary embodiment of FIG. 7, the attitude of the sliding door 11 may be maintained through an external structure for the maintenance of attitude.

Referring to FIGS. 5 and 7, the guide mechanism according to the exemplary embodiments of the present disclosure may further include a second transmission device 45 transmitting mechanical power generated by the motor module 40 to the sliding door 11.

The second transmission device 45 may include a wire 42 fixed to the sliding door 11 and a friction roller 46 moving the wire 42.

Referring to FIG. 3, both ends of the wire 42 may be fixed to the sliding door 11 by two fixed brackets 42*a* and 42*b*, and thus the wire 42 may be tensioned and extend in a longitudinal direction of the sliding door 11.

Referring to FIGS. 5 and 7, the friction roller 46 may be fixed to the first shaft 21, and the friction roller 46 may be located within the motor housing 41. An outer peripheral surface of the friction roller 46 may directly contact the wire 42. For example, the friction roller 46 may have a high friction surface formed on the outer peripheral surface thereof.

As the rotor 41*a* of the motor housing 41 rotates, the first shaft 21 and the friction roller 46 may rotate together in the same direction, and the wire 42 may move linearly in the longitudinal direction of the vehicle by a friction force between the wire 42 and the friction roller 46. As the wire 42 is moved by the friction roller 46 in the longitudinal direction of the vehicle, the sliding door 11 may slide in the longitudinal direction of the vehicle. That is, the sliding door 11 may slide in the longitudinal direction of the vehicle by the motor module 40 and the second transmission device 45. Referring to FIGS. 5 and 7, the motor housing 41 may have a wiring hole 41*c* through which the wire 42 passes. When the wire 42 and the sliding door 11 move linearly in the longitudinal direction of the vehicle by the motor module 40 and the second transmission device 45, the movement of the rail 12 may be guided by rollers 16.

Figure 8:
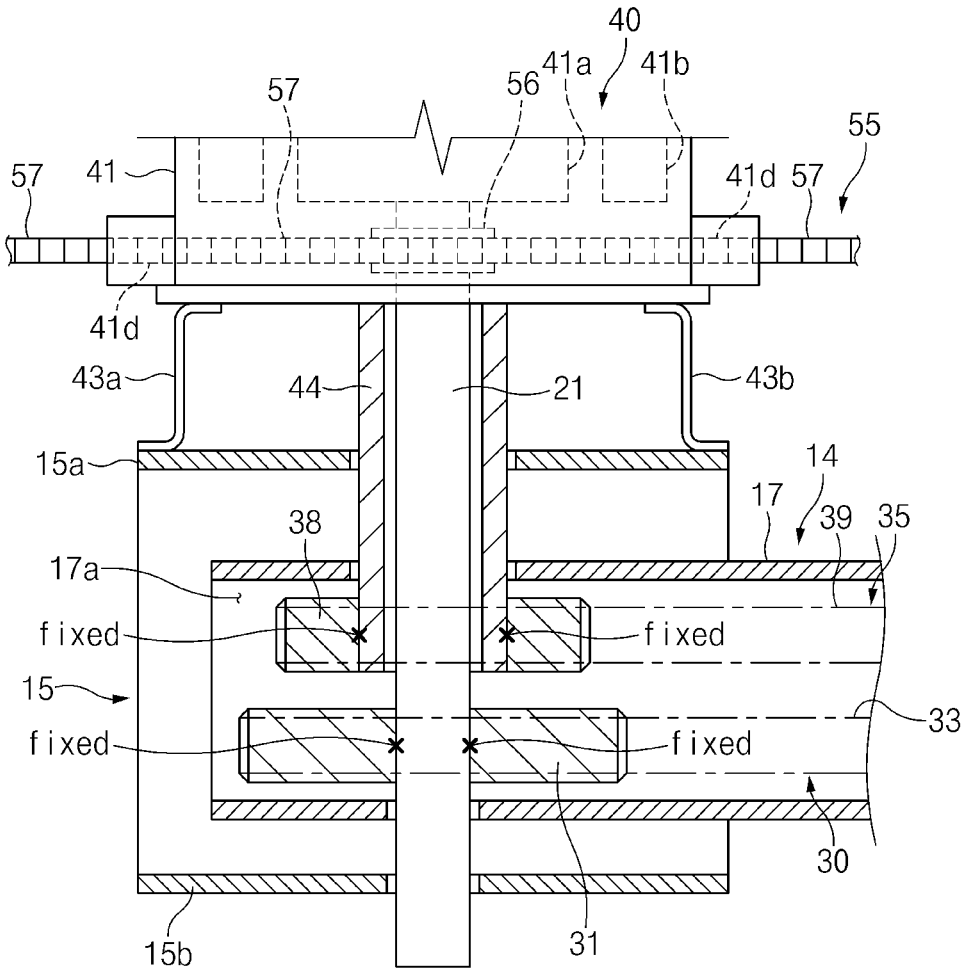
FIG. 8 illustrates an alternative to a second transmission device illustrated in FIGS. 5 and 7.

FIG. 8 illustrates a second transmission device 55 including a rack gear 57 fixed to the sliding door 11, and a pinion gear 56 meshing with the rack gear 57, according to another exemplary embodiment of the present disclosure.

Referring to FIG. 8, the rack gear 57 may extend in the longitudinal direction of the sliding door 11, and the rack gear 57 may be fixed to the sliding door 11 using fasteners, welding, and/or the like.

The pinion gear 56 may be fixed to the first shaft 21. Teeth of the pinion gear 56 may mesh with teeth of the rack gear 57, and the pinion gear 56 may be located within the motor housing 41. As the rotor 41*a* of the motor housing 41 rotates, the first shaft 21 and the pinion gear 56 may rotate in the same direction, and the rack gear 57 may move linearly in the longitudinal direction of the vehicle by the rotation of the pinion gear 56. As the rack gear 57 moves in the longitudinal direction of the vehicle, the sliding door 11 may slide in the longitudinal direction of the vehicle. That is, the sliding door 11 may slide by the motor module 40 and the second transmission device 55. Referring to FIG. 8, the motor housing 41 may have a hole 41*d* through which the rack gear 57 passes.

As the mechanical power (rotational force) generated by the motor module 40 is transmitted to the sliding door 11 through the pinion gear 56 and the rack gear 57, the sliding door 11 may move linearly in the longitudinal direction of the vehicle.

Figure 9:
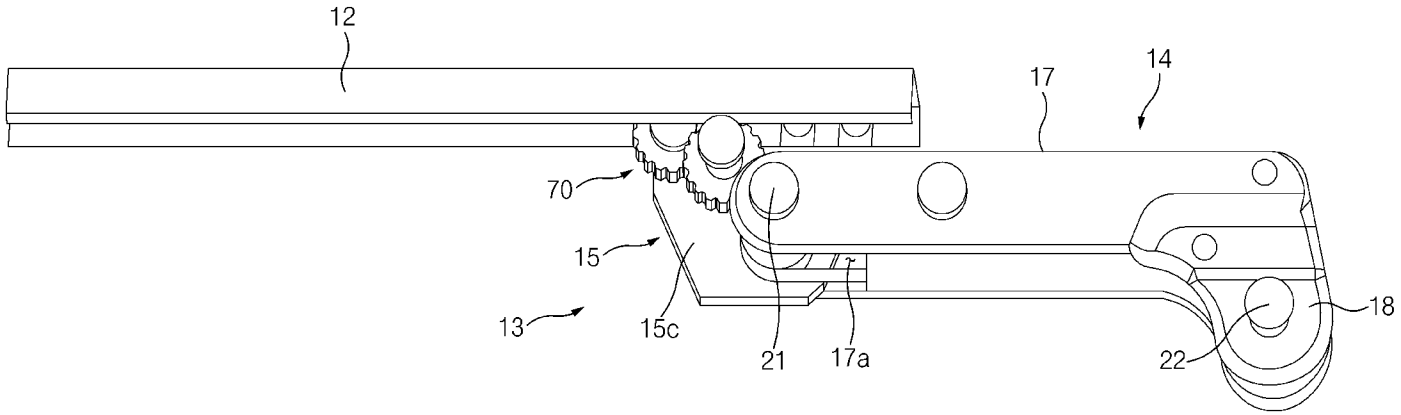
FIG. 9 illustrates a perspective view of a guide mechanism for a sliding door according to another exemplary embodiment of the present disclosure.
Figure 10:
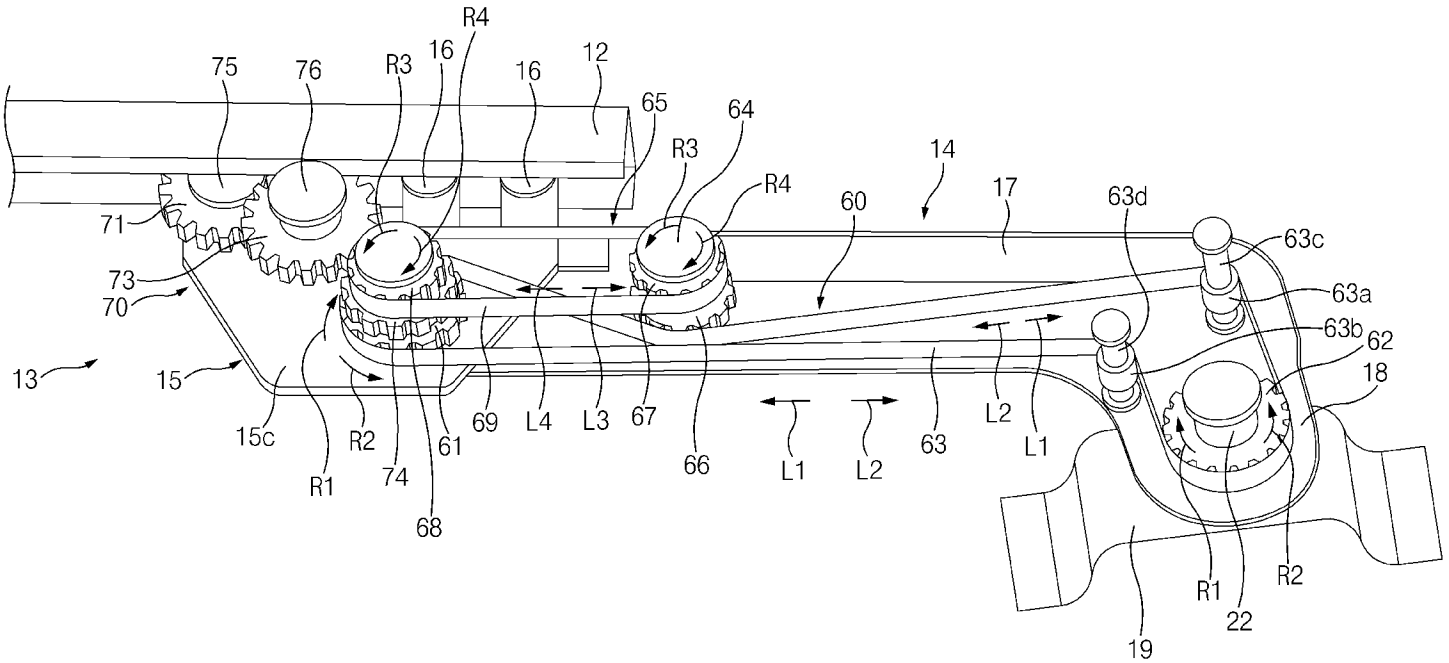
FIG. 10 illustrates a structure of the guide mechanism for a sliding door illustrated in FIG. 9 from which a top of a hinge arm is removed.

Referring to FIGS. 9 and 10, at least one of the upper guide mechanism 100 and the lower guide mechanism 200 may further include a gear train 70 generating mechanical power such as a rotational force or torque by the linear movement (sliding) of the sliding door 11 and a transmission device 60 transmitting the mechanical power generated by the gear train 70 to the hinge arm 14. That is, the hinge arm 14 may pivot around the second shaft 22 by the gear train 70 and the transmission device 60. When the sliding door 11 is moved linearly and manually by a user, the gear train 70 may turn the linear movement (sliding) of the sliding door 11 into the rotational movement of the first shaft 21. The first shaft 21 may rotate by the operation of the gear train 70, and the rotational force of the first shaft 21 may be transmitted to the hinge arm 14 through the transmission device 60, and thus the hinge arm 14 may pivot around the second shaft 22.

The hinge arm 14 may have a space for receiving the transmission device 60 therein, and the first body 17 of the hinge arm 14 may have the opening 17*a*.

The gear train 70 may include a driving gear 71 contacting the rail 12, a first intermediate gear 72 meshing with the driving gear 71, a second intermediate gear 73 fixed to the first intermediate gear 72, and a driven gear 74 meshing with the second intermediate gear 73. As a gear ratio of the gear train 70 is varied, the linear movement (sliding) of the sliding door 11 and the pivot range of the hinge arm 14 may be adjusted.

Figure 11:
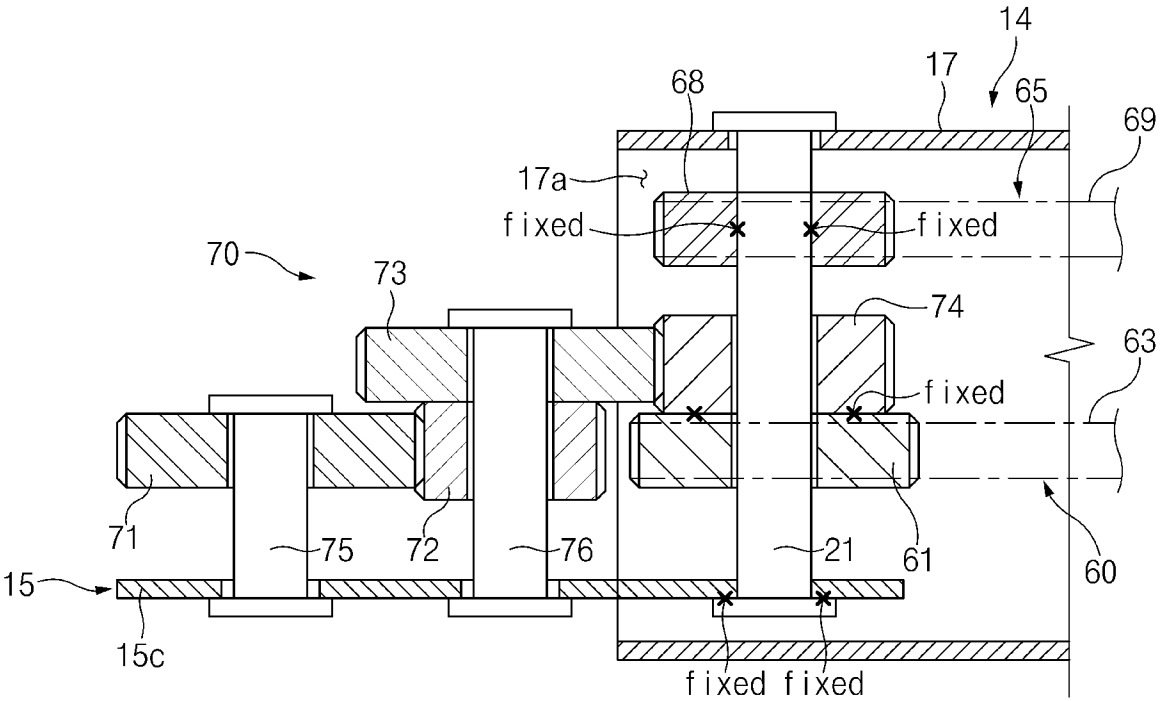
FIG. 11 illustrates a cross-sectional view of the guide mechanism for a sliding door illustrated in FIG. 9 in which a hinge arm and a roller bracket are connected by a gear train and a first shaft.

Referring to FIGS. 10 and 11, the roller bracket 15 of the roller carriage 13 may have a plate 15*c*, and a first post 75 and a second post 76 may be fixed to the plate 15*c* of the roller bracket 15.

As the driving gear 71 directly contacts the rail 12, the driving gear 71 may roll along the rail 12, and the driving gear 71 may be rotatably mounted on the first post 75. When the user grips an outside handle of the sliding door 11 and moves the sliding door 11 in the longitudinal direction of the vehicle, the rail 12 may linearly move with the sliding door 11 and the driving gear 71 may rotate around the first post 75. The driving gear 71 may have teeth spaced apart from each other at a predetermined pitch on an outer peripheral surface thereof.

The first intermediate gear 72 may be coaxially aligned with the second intermediate gear 73, and the first intermediate gear 72 and the second intermediate gear 73 may be rotatably mounted on the second post 76.

The first intermediate gear 72 may have teeth spaced apart from each other at a predetermined pitch on an outer peripheral surface thereof, and the teeth of the driving gear 71 may mesh with the teeth of the first intermediate gear 72. An inner peripheral surface of the first intermediate gear 72 may be rotatably supported with respect to an outer peripheral surface of the second post 76 through bushings, bearings, and/or the like.

The second intermediate gear 73 may have teeth spaced apart from each other at a predetermined pitch on an outer peripheral surface thereof, and the second intermediate gear 73 may be fixed to a top surface of the first intermediate gear 72 using fasteners, welding, and/or the like. An inner peripheral surface of the second intermediate gear 73 may be rotatably supported with respect to the outer peripheral surface of the second post 76 through bushings, bearings, and/or the like. The first intermediate gear 72 and the second intermediate gear 73 may rotate together around the second post 76 in the same direction.

The driven gear 74 may be rotatably mounted around the first shaft 21. In particular, the driven gear 74 may be rotatably supported with respect to the first shaft 21 through bushings, bearings, and/or the like, and the driven gear 74 may rotate freely with respect to the first shaft 21. The driven gear 74 may have teeth spaced apart from each other at a predetermined pitch on an outer peripheral surface thereof, and the teeth of the second intermediate gear 73 may mesh with the teeth of the driven gear 74. The driven gear 74 may be received in the receiving space of the hinge arm 14 through the opening 17*a* of the first body 17 of the hinge arm 14.

The transmission device 60 may be mounted in the receiving space of the hinge arm 14. Referring to FIGS. 10 and 11, the transmission device 60 may include a first gear 61 rotatably mounted on the first shaft 21, a second gear 62 rotatably mounted on the second shaft 22, and a first belt 63 connecting the first gear 61 and the second gear 62.

As the first gear 61 is fixed to the driven gear 74 of the gear train 70, the first gear 61 may be operatively connected to the gear train 70. The first gear 61 may be coaxially aligned with the driven gear 74, and the first gear 61 may be fixed to the driven gear 74 of the gear train 70. For example, the first gear 61 may be fixed to a bottom surface of the driven gear 74. As another example, the first gear 61 may be one-piece construction with the driven gear 74. The first gear 61 may rotate with the driven gear 74 in the same direction. The first gear 61 and the driven gear 74 may be rotatably supported with respect to the first shaft 21 through bushings, bearings, and/or the like.

The second gear 62 may have teeth spaced apart from each other at a predetermined pitch on an outer peripheral surface thereof, and the second gear 62 may be rotatably mounted on the second shaft 22.

The second gear 62 may rotate freely with respect to the second shaft 22. Specifically, an inner peripheral surface of the second gear 62 may be rotatably supported with respect to the outer peripheral surface of the second shaft 22 through bushings, bearings, and/or the like. A bottom surface of the second gear 62 may be fixed to the bottom of the second body 18 of the hinge arm 14 using fasteners, welding, and/or the like. The second gear 62 may rotate around the second shaft 22, and the hinge arm 14 may pivot around the second shaft 22 by the rotation of the second gear 62.

The first belt 63 may have an inner surface facing the first gear 61 and the second gear 62, and an outer surface opposing the inner surface. As illustrated in FIG. 6A, the first belt 63 may include a plurality of first teeth 51 spaced apart from each other at a predetermined pitch on the inner surface thereof, and a plurality of second teeth 52 spaced apart from each other at a predetermined pitch on the outer surface thereof. The plurality of first teeth 51 may mesh with the teeth of the first gear 61 and the teeth of the second gear 62. The plurality of second teeth 52 may mesh with teeth of a third gear 66 of an attitude maintenance mechanism 65 to be described below.

A plurality of guide rollers 63*a* and 63*b* may be disposed between the first gear 61 and the second gear 62, and the guide rollers 63*a* and 63*b* may be disposed around posts 63*c* and 63*d*, respectively. For example, the guide rollers 63*a* and 63*b* may be rotatably mounted on the corresponding posts 63*c* and 63*d*. The first belt 63 may be tensioned and guided to the first gear 61 and the second gear 62 through the plurality of guide rollers 63*a* and 63*b*. In particular, the plurality of guide rollers 63*a* and 63*b* may be disposed in a portion of the hinge arm 14 where the first body 17 and the second body 18 meet, and thus the first belt 63 may be tensioned and guided more stably.

Referring to FIGS. 10 and 11, at least one of the upper guide mechanism 100 and the lower guide mechanism 200 may further include the attitude maintenance mechanism 65 which maintains the sliding door 11 in a predetermined attitude, and the attitude maintenance mechanism 65 may be operatively connected to the transmission device 60. When the sliding door 11 is opened and closed, the sliding door 11 may be maintained in a predetermined attitude by the attitude maintenance mechanism 65 so that the opening and closing operation of the sliding door 11 may be facilitated.

Preferably, the attitude maintenance mechanism 65 may maintain the sliding door 11 in an attitude parallel to the longitudinal axis of the vehicle or the side of the vehicle.

The attitude maintenance mechanism 65 may include the third gear 66 contacting the first belt 63 of the transmission device 60, a fourth gear 67 fixed to a top surface of the third gear 66, a fifth gear 68 fixed to the first shaft 21, and a second belt 69 connecting the fourth gear 67 and the fifth gear 68.

The third gear 66 may be coaxially aligned with the fourth gear 67, and the third gear 66 and the fourth gear 67 may be rotatably mounted on a post 64. The post 64 may be located between the first shaft 21 and the second shaft 22. The post 64 may be mounted within the first body 17 of the hinge arm 14, and an axis of the post 64 may be parallel to the axis of the first shaft 21.

An inner peripheral surface of the third gear 66 may be rotatably supported with respect to an outer peripheral surface of the post 64 through bushings, bearings, and/or the like. The third gear 66 may have a plurality of teeth spaced apart from each other at a predetermined pitch on an outer peripheral surface thereof, and the second teeth 52 of the first belt 63 of the transmission device 60 may mesh with the teeth of the third gear 66. As the second teeth 52 of the first belt 63 mesh with the teeth of the third gear 66, the third gear 66 may be rotated by the movement of the first belt 63.

The fourth gear 67 may have a plurality of teeth spaced apart from each other at a predetermined pitch on an outer peripheral surface thereof, and the fourth gear 67 may be fixed to the top surface of the third gear 66 using fasteners, welding, and/or the like. An inner peripheral surface of the fourth gear 67 may be rotatably supported with respect to the outer peripheral surface of the post 64 through bushings, bearings, and/or the like. The third gear 66 and the fourth gear 67 may rotate together around the post 64 in the same direction.

The fifth gear 68 may have a plurality of teeth spaced apart from each other at a predetermined pitch on an outer peripheral surface thereof, and the fifth gear 68 may be fixed to the first shaft 21. The first shaft 21 may be fixed to the plate 15*c* of the roller bracket 15 using fasteners, welding, and/or the like. For example, an inner peripheral surface of the fifth gear 68 may be fixed to the outer peripheral surface of the first shaft 21 using keyed joints, welding, and/or the like. As another example, the fifth gear 68 may be one-piece construction with the first shaft 21. The roller bracket 15 may rotate with the fifth gear 68 in the same direction.

As illustrated in FIG. 6B, the second belt 69 may have a plurality of teeth 53 meshing with the teeth of the fourth gear 67 and the teeth of the fifth gear 68. As the second belt 69 moves, the fourth gear 67 and the fifth gear 68 may rotate in the same direction.

Referring to FIG. 10, when the sliding door 11 is opened manually by the user, the gear train 70 may turn the linear movement (sliding) of the sliding door 11 into the rotational movement, and thus the driven gear 74 may rotate in a first rotation direction R1. As the first gear 61 rotates with the driven gear 74 in the first rotation direction R1, the first belt 63 may move in a first direction L1 and the second gear 62 may rotate in the first rotation direction R1. As the second gear 62 rotates in the first rotation direction R1, the hinge arm 14 may pivot from the first pivot position P1 (see FIG. 2A) to the third pivot position P3 (see FIG. 2B) and/or the second pivot position P2 (see FIG. 2C). That is, in order to open the sliding door 11, the hinge arm 14 may pivot from the first pivot position P1 to the third pivot position P3 and/or the second pivot position P2 by the transmission device 60. When the first belt 63 moves in the first direction L1, the third gear 66 meshing with the second teeth of the first belt 63 may rotate in a third rotation direction R3, and the fourth gear 67 may rotate with the third gear 66 in the third rotation direction R3. The third rotation direction R3 may be opposite to the first rotation direction R1. As the fourth gear 67 rotates in the third rotation direction R3, the second belt 69 may move in a third direction L3, and thus the fifth gear 68 may rotate in the third rotation direction R3, and the first shaft 21 and the roller bracket 15 may rotate with the fifth gear 68 in the third rotation direction R3. Since the third rotation direction R3 is opposite to the first rotation direction R1, the roller bracket 15, the rail 12, and the sliding door 11 may receive the rotational force in the opposite direction to the pivot direction of the hinge arm 14, and thus the sliding door 11 may be maintained in the attitude parallel to the side of the vehicle body 5 when the sliding door 11 is opened.

Referring to FIG. 10, when the sliding door 11 is closed manually by the user, the gear train 70 may turn the linear movement (sliding) of the sliding door 11 into the rotational movement, and thus the driven gear 74 may rotate in a second rotation direction R2. As the first gear 61 rotates with the driven gear 74 in the second rotation direction R2, the first belt 63 may move in a second direction L2, and the second gear 62 may rotate in the second rotation direction R2. As the second gear 62 rotates in the second rotation direction R2, the hinge arm 14 may pivot from the second pivot position P2 (see FIG. 2C) to the third pivot position P3 (see FIG. 2B) and/or the first pivot position P1 (see FIG. 2A). That is, in order to close the sliding door 11, the hinge arm 14 may pivot from the second pivot position P2 to the third pivot position P3 and/or the first pivot position P1 by the transmission device 60. When the first belt 63 moves in the second direction L2, the third gear 66 meshing with the second teeth of the first belt 63 may rotate in a fourth rotation direction R4, and the fourth gear 67 may rotate with the third gear 66 in the fourth rotation direction R4. The fourth rotation direction R4 may be opposite to the second rotation direction R2. As the fourth gear 67 rotates in the fourth rotation direction R4, the second belt 69 may move in a fourth direction L4, and thus the fifth gear 68 may rotate in the fourth rotation direction R4, and the first shaft 21 and the roller bracket 15 may rotate with the fifth gear 68 in the fourth rotation direction R4. Since the fourth rotation direction R4 is opposite to the second rotation direction R2, the roller bracket 15, the rail 12, and the sliding door 11 may receive the rotational force in the opposite direction to the pivot direction of the hinge arm 14, and thus the sliding door 11 may be maintained in the attitude parallel to the side of the vehicle body 5 when the sliding door 11 is closed.

Figure 12:
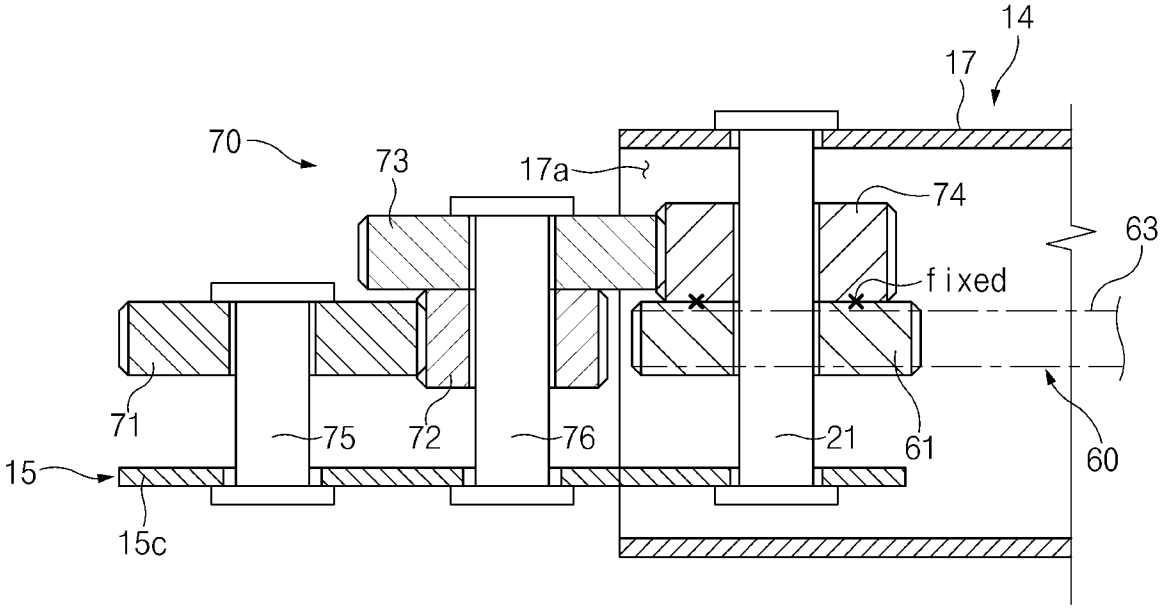
FIG. 12 illustrates a modification to the embodiment of FIG. 11.

FIG. 12 illustrates a modification to the exemplary embodiment of FIG. 11. In the modified embodiment of FIG. 12, the attitude maintenance mechanism operatively connected to the transmission device 60 is removed. Referring to FIG. 12, the first shaft 21 may rotate freely with respect to the plate 15*c* of the roller bracket 15. That is, the first shaft 21 may be rotatably supported with respect to the plate 15*c* of the roller bracket 15 through bushings, bearings, and/or the like. The first shaft 21 may be rotatably supported with respect to the first body 17 of the hinge arm 14 through bushings, bearings, and/or the like.

According to the exemplary embodiment of FIG. 12, the first shaft 21 may rotate freely with respect to the first body 17 of the hinge arm 14 and the roller bracket 15, and the attitude maintenance mechanism may be removed. In the exemplary embodiment of FIG. 12, the attitude of the sliding door 11 may be maintained through an external structure for the maintenance of attitude.

According to an exemplary embodiment, the motor module 40, the first transmission device 30, and the second transmission device 45 or 55 may be applied to both the upper guide mechanism 100 and the lower guide mechanism 200. Thus, the sliding door 11 may be opened and closed electrically or automatically by the motor module 40.

According to another exemplary embodiment, the gear train 70 and the transmission device 60 may be applied to both the upper guide mechanism 100 and the lower guide mechanism 200. Thus, the sliding door 11 may be opened and closed manually by the gear train 70.

According to another exemplary embodiment, the motor module 40, the first transmission device 30, and the second transmission device 45 or 55 may be applied to the upper guide mechanism 100, and the gear train 70 and the transmission device 60 may be applied to the lower guide mechanism 200.

According to another exemplary embodiment, the motor module 40, the first transmission device 30, and the second transmission device 45 or 55 may be applied to the lower guide mechanism 200, and the gear train 70 and the transmission device 60 may be applied to the upper guide mechanism 100.

As set forth above, according to exemplary embodiments of the present disclosure, the hinge arm 14 may be pivotally connected to the vehicle body 5, and the rail 12 may be mounted on the sliding door 11 so that the rail 12 may not be exposed to the interior and exterior of the vehicle when the sliding door 11 is opened, and thus exterior styling may be improved.

According to exemplary embodiments of the present disclosure, since the rail 12 is not mounted on the side of the vehicle body 5 but is mounted on the sliding door 11, a cross-sectional area of a side structural member such as a side sill may be relatively increased. Thus, a battery protection space may be increased and side stiffness and side crashworthiness of the vehicle body may be improved.

According to exemplary embodiments of the present disclosure, since the rail 12 is not mounted on the side of the vehicle body 5 but is mounted on the sliding door 11, a battery mounting space may be relatively increased. By increasing the capacity of the battery, a driving range of an eco-friendly vehicle such as an electric vehicle may be increased.

According to exemplary embodiments of the present disclosure, the sliding door 11 may be maintained in a predetermined attitude by the attitude maintenance mechanism when the sliding door is opened and closed, and two guide mechanisms (the upper guide mechanism and the lower guide mechanism) may constitute a sliding door system. While a sliding door system according to the related art has three guide mechanisms (an upper guide mechanism a lower guide mechanism, and a center guide mechanism), the sliding door system 10 according to exemplary embodiments of the present disclosure has two guide mechanisms 100 and 200, which reduces the number of components required and simplifies an assembly process, resulting in reduced manufacturing cost and reduced weight.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A guide mechanism for a sliding door, the guide mechanism comprising:

a rail configured to be mounted on the sliding door;

a roller carriage configured to move along the rail, the roller carriage including a roller bracket and a roller rotatably mounted on the roller bracket;

a hinge arm configured to be pivotally connected to a vehicle body;

a first shaft pivotally connecting the roller carriage to the hinge arm; and a second shaft configured to pivotally connect the hinge arm to the vehicle body, wherein the hinge arm is configured to pivot around the second shaft by a motor module and a transmission device;

wherein the motor module is fixed to the roller bracket,
wherein the first shaft is connected to the motor module;
wherein the transmission device includes a first gear fixed to the first shaft, a second gear disposed around the second shaft, and a first belt connecting the first gear and the second gear; and
wherein the second gear is fixed to the hinge arm.

2. The guide mechanism according to claim 1, wherein the rail is a straight rail extending in a longitudinal direction of the vehicle body.

3. The guide mechanism according to claim 1, wherein:
the hinge arm is configured to pivot around the second shaft to move between a first pivot position and a second pivot position;
when the hinge arm is in the first pivot position, the sliding door is in a fully closed position; and
when the hinge arm is in the second pivot position, the sliding door is in a fully open position.

4. The guide mechanism according to claim 3, wherein the roller bracket and the hinge arm are configured to rotate freely with respect to the first shaft, and the hinge arm is configured to rotate freely with respect to the second shaft.

5. The guide mechanism according to claim 1, wherein the first belt includes a plurality of first teeth configured to mesh with teeth of the first gear and teeth of the second gear.

6. The guide mechanism according to claim 1, further comprising an attitude maintenance mechanism operatively connected to the transmission device, wherein the attitude maintenance mechanism includes a third gear operatively connected to the first belt, a fourth gear fixed to the third gear, a fifth gear disposed around the first shaft, and a second belt connecting the fourth gear and the fifth gear, and wherein the fifth gear is connected to the roller bracket through the motor module.

7. The guide mechanism according to claim 6, wherein the motor module has a cylinder portion extending toward the fifth gear, the cylinder portion surrounds the first shaft, and the fifth gear is fixed to the cylinder portion.

8. The guide mechanism according to claim 6, wherein the first belt includes a plurality of second teeth configured to mesh with teeth of the third gear.

9. A guide mechanism for a sliding door, the guide mechanism comprising:
a rail configured to be mounted on the sliding door;
a roller carriage configured to move along the rail, the roller carriage including a roller bracket and a roller rotatably mounted on the roller bracket;
a hinge arm configured to be pivotally connected to a vehicle body;
a first shaft pivotally connecting the roller carriage to the hinge arm;
a second shaft configured to pivotally connect the hinge arm to the vehicle body;
wherein the hinge arm is configured to pivot around the second shaft to move between a first pivot position and a second pivot position;
wherein, when the hinge arm is in the first pivot position, the sliding door is in a fully closed position; and
wherein, when the hinge arm is in the second pivot position, the sliding door is in a fully open position;
wherein the hinge arm is configured to pivot around the second shaft by a motor module and a transmission device;
wherein the motor module is fixed to the roller bracket;
wherein the first shaft is connected to the motor module;
wherein the transmission device includes a first gear fixed to the first shaft, a second gear disposed around the second shaft, and a first belt connecting the first gear and the second gear; and
wherein the second gear is fixed to the hinge arm.

10. The guide mechanism according to claim 9, wherein the first belt includes a plurality of first teeth configured to mesh with teeth of the first gear and teeth of the second gear.

11. The guide mechanism according to claim 9, further comprising an attitude maintenance mechanism operatively connected to the transmission device, wherein the attitude maintenance mechanism includes a third gear operatively connected to the first belt, a fourth gear fixed to the third gear, a fifth gear disposed around the first shaft, and a second belt connecting the fourth gear and the fifth gear, and wherein the fifth gear is connected to the roller bracket through the motor module.

12. The guide mechanism according to claim 11, wherein the motor module has a cylinder portion extending toward the fifth gear, the cylinder portion surrounds the first shaft, and the fifth gear is fixed to the cylinder portion.

13. The guide mechanism according to claim 11, wherein the first belt includes a plurality of second teeth configured to mesh with teeth of the third gear.

14. The guide mechanism according to claim 9, wherein the rail is a straight rail extending in a longitudinal direction of the vehicle body.

15. The guide mechanism according to claim 9, wherein the roller bracket and the hinge arm are configured to rotate freely with respect to the first shaft, and the hinge arm is configured to rotate freely with respect to the second shaft.

16. A guide mechanism for a sliding door, the guide mechanism comprising:
a rail configured to be mounted on the sliding door;
a roller carriage configured to move along the rail, the roller carriage including a roller bracket and a roller rotatably mounted on the roller bracket;
a hinge arm configured to be pivotally connected to a vehicle body;
a first shaft pivotally connecting the roller carriage to the hinge arm; and
a second shaft configured to pivotally connect the hinge arm to the vehicle body;
wherein the hinge arm is configured to pivot around the second shaft to move between a first pivot position and a second pivot position;
wherein, when the hinge arm is in the first pivot position, the sliding door is in a fully closed position;
wherein, when the hinge arm is in the second pivot position, the sliding door is in a fully open position;
wherein the hinge arm is configured to pivot around the second shaft by a gear train and a transmission device;
the gear train is configured to turn a linear movement of the sliding door into a rotational movement of the first shaft;
the transmission device includes a first gear rotatably mounted on the first shaft, a second gear rotatably mounted on the second shaft, and a first belt connecting the first gear and the second gear;
the first gear is operatively connected to the gear train; and
the second gear is fixed to the hinge arm.

17. The guide mechanism according to claim 16, wherein the gear train includes a driving gear contacting the rail, a first intermediate gear configured to mesh with the driving gear, a second intermediate gear fixed to the first intermediate gear, and a driven gear configured to mesh with the second intermediate gear, and wherein the driven gear is fixed to the first gear.

18. The guide mechanism according to claim 16, further comprising an attitude maintenance mechanism operatively connected to the transmission device, wherein the attitude maintenance mechanism includes a third gear operatively connected to the first belt, a fourth gear fixed to the third gear, a fifth gear fixed to the first shaft, and a second belt connecting the fourth gear and the fifth gear, and wherein the first shaft is fixed to the roller bracket.

19. The guide mechanism according to claim 16, wherein the rail is a straight rail extending in a longitudinal direction of the vehicle body.

20. The guide mechanism according to claim 16, wherein the roller bracket and the hinge arm are configured to rotate freely with respect to the first shaft, and the hinge arm is configured to rotate freely with respect to the second shaft.

* * * * *